US011268719B2

(12) United States Patent
Broker

(10) Patent No.: US 11,268,719 B2
(45) Date of Patent: Mar. 8, 2022

(54) CIRCULATOR FAILURE DETECTION IN HVAC SYSTEMS

(71) Applicant: EMERSON ELECTRIC CO., St. Louis, MO (US)

(72) Inventor: John F. Broker, Warrenton, MO (US)

(73) Assignee: Emerson Electric Co., St. Louis, MO (US)

( * ) Notice: Subject to any disclaimer, the term of this patent is extended or adjusted under 35 U.S.C. 154(b) by 141 days.

(21) Appl. No.: 16/128,043

(22) Filed: Sep. 11, 2018

(65) Prior Publication Data

US 2020/0080740 A1 Mar. 12, 2020

(51) Int. Cl.

| | |
|---|---|
| ***F24F 11/38*** | (2018.01) |
| ***F24F 11/88*** | (2018.01) |
| *F28D 20/00* | (2006.01) |
| *F28D 15/04* | (2006.01) |

(52) U.S. Cl.

CPC ..... *F24F 11/38* (2018.01); *F24F 11/88* (2018.01); *F28D 15/046* (2013.01); *F28D 2020/0017* (2013.01)

(58) Field of Classification Search

CPC ..... F24F 11/38; F24F 11/88; F28D 15/046; F28D 2020/0017

See application file for complete search history.

(56) References Cited

U.S. PATENT DOCUMENTS

| | | | | |
|---|---|---|---|---|
| 4,465,962 | A * | 8/1984 | Kirschbaum | H02P 25/24 318/813 |
| 5,076,780 | A * | 12/1991 | Erdman | F23N 5/242 431/24 |
| 5,233,324 | A * | 8/1993 | Beihoff | H01F 38/30 336/174 |
| 8,008,603 | B2 | 8/2011 | MacKenzie | |
| 9,178,447 | B2 * | 11/2015 | Broker | H02P 6/00 |
| 10,605,495 | B1 * | 3/2020 | Falls | F24F 11/0001 |
| 2003/0160519 | A1 * | 8/2003 | Muldoon | G05B 17/02 307/149 |
| 2009/0056649 | A1 * | 3/2009 | MacKenzie | F22B 37/42 122/504 |
| 2010/0076606 | A1 * | 3/2010 | Gatley | F04D 27/004 700/276 |
| 2011/0151387 | A1 * | 6/2011 | Greene | F23N 5/203 431/66 |

(Continued)

FOREIGN PATENT DOCUMENTS

JP 2017112674 A * 6/2017

*Primary Examiner* — Elizabeth J Martin
*Assistant Examiner* — Nael N Babaa
(74) *Attorney, Agent, or Firm* — Harness, Dickey & Pierce, P.L.C.; Anthony Fussner

(57) ABSTRACT

An example HVAC system includes a furnace including a gas valve, a circulator motor to circulate air through the HVAC system, and a current sensor configured to detect a current supplied to the circulator motor. The system also includes a controller configured to disable the gas valve when a detected current supplied to the circulator motor is outside of a specified operating current range. A detected current to the circulator motor outside of the specified operating current range is indicative of a malfunction of the circulator motor. Example methods of operating a gas valve in an HVAC system are also disclosed.

20 Claims, 3 Drawing Sheets

(56) References Cited

U.S. PATENT DOCUMENTS

| | | | | |
|---|---|---|---|---|
| 2011/0250547 | A1* | 10/2011 | Brown | F23N 5/242 431/2 |
| 2014/0074730 | A1* | 3/2014 | Arensmeier | G06Q 10/20 705/305 |
| 2017/0167744 | A1* | 6/2017 | Arensmeier | F04D 25/06 |
| 2017/0211822 | A1* | 7/2017 | Perez | F23D 91/02 |
| 2017/0299200 | A1* | 10/2017 | Mercier, Sr. | F24D 19/1012 |

* cited by examiner

CIRCULATOR FAILURE DETECTION IN HVAC SYSTEMS

FIELD

The present disclosure generally relates to circulator failure detection in HVAC systems.

BACKGROUND

This section provides background information related to the present disclosure which is not necessarily prior art.

In a furnace, a circulator allows the unit to provide heating, cooling, and fan functions without reaching upper and lower temperature limits of other parts of the HVAC system. When a failure occurs, it may be difficult to determine whether there is a failed control, a failed wire harness/connector, or a failed circulator motor. For example, for communicating motors such as permanent split capacitance (PSC) and X-13 type ECM motors, diagnostics and failure detection are limited.

DRAWINGS

The drawings described herein are for illustrative purposes only of selected embodiments and not all possible implementations, and are not intended to limit the scope of the present disclosure.

Corresponding reference numerals indicate corresponding (although not necessarily identical) parts throughout the several views of the drawings.

DETAILED DESCRIPTION

Figure 1:
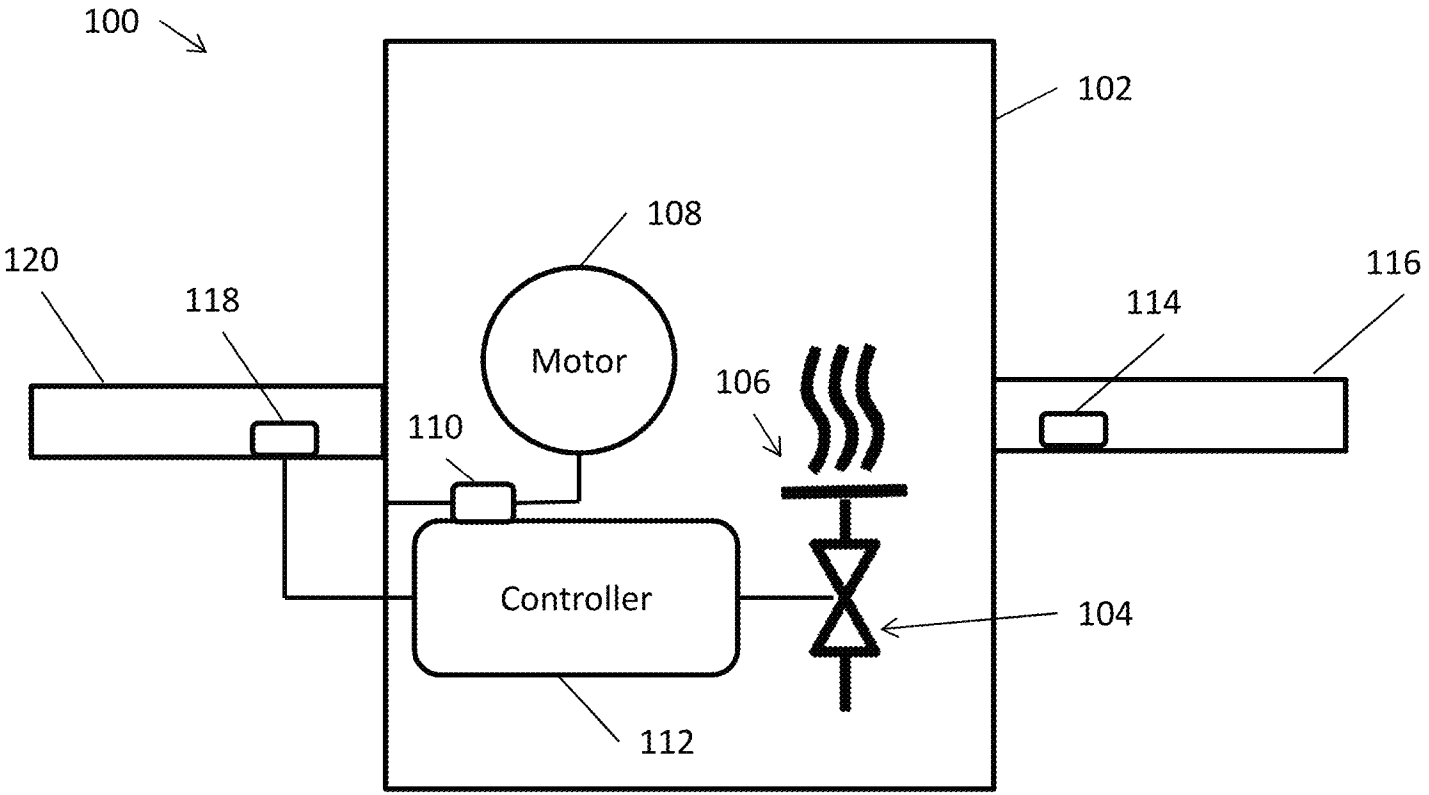
FIG. 1 is a block diagram of an HVAC system according to one example embodiment of the present disclosure.

Example embodiments will now be described more fully with reference to the accompanying drawings.

In a furnace, a circulator allows the unit to provide heating, cooling, and fan functions without reaching upper and lower temperature limits of other parts of the HVAC system. When a failure occurs, it may be difficult to determine whether there is a failed control, a failed wire harness/connector, or a failed circulator motor. For example, for communicating motors such as permanent split capacitance (PSC) and X-13 type ECM motors, diagnostics and failure detection are limited.

Accordingly, the inventor has developed and disclosed herein exemplary embodiments of HVAC systems having a current sensor (e.g., a current transformer, etc.) to monitor current to the circulator, and a control that can shut down the gas valve if the current is out of range. For example, one or more operating parameters of the HVAC system may be monitored to detect an issue with the HVAC system, and the monitored operating parameters can be used to provide diagnostic information, to stop operation to inhibit equipment damage or other undesirable operations, etc.

Example monitored operating parameters include, but are not limited to, a measured current of a control signal to a circulator motor, a measured supply current (e.g., a current corresponding to a 120 VAC supply, etc.) to the circulator motor, measured air temperatures in a supply and/or return of the HVAC system, etc.

In some example embodiments, a supply current to the circulator motor can be monitored to determine whether the circulator motor is running. If the circulator motor is instructed (e.g., commanded by a control signal, etc.) to run at a specified speed, and the current supplied to the circulator motor is outside of a specified operating current range (e.g., the supplied current does not match an expected value, etc.), the circulator motor may be determined as not running, running at an incorrect speed, etc.

A determination that the circulator motor is not running properly (e.g., a circulator motor failure, etc.) can be used in combination with a monitored voltage of a control signal leaving a control (e.g., to be supplied to the circulator motor, etc.) in order to verify that the control is sending a correct control signal voltage to the circulator motor.

These operating parameters can be detected at startup of the HVAC system, the furnace, the circulator motor, etc. Additionally, or alternatively, these parameters may be detected during a cycle of the HVAC system, the furnace, the circulator motor, etc., possibly when a change occurs in the system, a component fails during a cycle, etc.

A connection for circulator motors, such as X-13 type ECM motors, can be tested by measuring current in taps of the motor. For example, current level over time can be measured, voltage output can be measured, etc. Some motors share optoisolators between taps, and use a diode in at least one of the taps. These types of motors can be detected and differentiated with other types that do not share optoisolators, which can be useful for determining driving signals for the motor and providing an alert if a technician uses a wrong type of replacement motor.

If a correct control signal voltage is detected leaving the control, but an incorrect current supplied to the circulator motor is detected, it may be determined that the HVAC control is working properly and there is a problem with the circulator motor, or a wire harness connection to the circulator motor. When current is detected in a tap of the motor, it can be determined that the motor tap is connected. In that case, a detection of no supply current supplied to the motor (e.g., a 120 VAC supply current) can indicate that the circulator motor has failed.

In some example embodiments, a return air temperature and/or a supply air temperature in the HVAC system can be measured to determine whether the circulator motor is working properly. Alternatively, or additionally, a pressure sensor and/or air flow sensor may be used to detect whether the circulator motor is working properly.

In some cases, any combination of one or more (or all) of the current sensor, return and/or supply air temperature sensor(s), a pressure sensor and an air flow sensor may be used to detect whether the circulator motor is working properly. Using multiple sensors may increase accuracy of detecting circulator motor failures.

Any suitable current sensor(s) may be used to detect a supply current to the circulator motor, such as a current transformer, a Hall effect sensor, etc. For example, a Hall effect sensor could be mounted on a side of a panel opposite to a trace, wire, etc. that supplies current to the circulator motor.

A control (e.g., stand-alone control board, integrated burner control, etc.) may detect whether the circulator motor is running for a specified time period after a call for heat and/or after the gas valve is energized or a flame is proven. If the current sensor is an upright current transformer, a current supply wire or bus bar to the circulator motor can extend through the current transformer (e.g., an L1 wire, a Neutral wire, etc.).

When the current supply wire or bus bar extends through the current transformer, it may not be necessary to add an additional connection to a control board, which can reduce a number of connections, improve reliability, reduce difficulty in adding the current sensor to an existing system, etc. As described above, sensing the supply current to the circulator motor can allow the controller to interrupt the gas valve after a predetermined period of time if proper operating supply current value(s) are not detected in the supply wire(s) to the circulator motor.

In some control boards, multi-position connectors may be used to increase ease of assembly, reduce chances of error for an operator to plug the wrong wire into a wrong connector, etc. A voltage line L1 may supply power to a board, and the board can pass the supplied power to other devices via copper trances, wires, etc. Other example devices can include, but are not limited to, communicating motors, transformers (e.g., a 24 VAC transformer), etc.

In some example embodiments, a multi-position connector may be used on a control board, and a wire, bus bar, etc., can extend through a current transformer to allow for sensing of the current supplied to the circulator motor. This can reduce or eliminate the need for plugging additional individual connector(s) into the control board, and allows for easier connections in a control board at a manufacturing plant and during component replacement in the field.

With reference now to the figures, FIG. 1 illustrates an exemplary embodiment of an HVAC system 100 for detecting a circulator motor failure. The HVAC system 100 includes a furnace 102 having a gas valve 104. The gas valve 104 can operate a burner 106 for heating air, etc., and may be varied (e.g., turned on and off, enabled and disabled, etc.) as desired to control the burner 106. For example, the gas valve 104 could be a modulating gas valve that can be varied to control an amount of gas flow to the burner 106 (e.g., the gas valve 104 could receive different modulation values or settings which allow or inhibit gas flow to the burner 106).

The HVAC system 100 includes a circulator motor 108 to circulate air through the HVAC system 100, and a current sensor 110 configured to detect a current supplied to the circulator motor 108. A controller 112 receives the detected current from the current sensor 110.

As described further below, the current sensor 110 may be part of the controller 112, may be separate from the controller 112, may be located on a same control board as the controller 112, etc. For example, the controller 112 could be a control of the HVAC system 100, may be separate from a control of the HVAC system 100, etc. The controller 112 can include a processor and memory that stores computer-executable instructions that are executable by the processor.

The controller 112 is configured to disable the gas valve 104 when a detected current supplied to the circulator motor 108 is outside of a specified operating current range. A detected current to the circulator motor 108 outside of a specified operating current range can be indicative of a malfunction of the circulator motor 108.

The current sensor 110 can include any suitable sensor for detecting a current supplied to the circulator motor 108, such as a current transformer, a Hall effect sensor, etc. When the current sensor 110 is a current transformer, one or more wires and/or bus bars may be connected to supply the current to the circulator motor 108, and the one or more wires and/or bus bars can extend through the current transformer. As explained further below, the one or more wires and/or bus bars can be coupled with a multi-position connector on a circuit board.

When the current sensor 110 is a Hall effect sensor, a conductive trace (e.g., a wire) supplying current to the circulator motor 108 may be located on a side of a panel. The current sensor 110 can be located on an opposite side of the panel to detect the value of the current supplied to the circulator motor 108.

As shown in FIG. 1, a supply air temperature sensor 114 is configured to detect an air temperature in a supply 116 (e.g., supply vent, etc.) of the HVAC system 100, and a return air temperature sensor 118 is configured to detect a return air temperature in a return 120 (e.g., return vent, etc.) of the HVAC system 100.

The supply air temperature sensor 114 and the return air temperature sensor 118 are in communication with the controller 112, via wired and/or wireless communication. The controller 112 is configured to disable the gas valve 104 in response to a detected return air temperature or a detected supply air temperature outside of a specified operating temperature range.

For example, if the detected air temperature indicates that the circulator motor 108 is not circulating air through the HVAC system 100 properly (e.g., because the detected air temperature is too high, is rising faster than normal, etc.), the controller 112 can disable the gas valve 104. Although FIG. 1 illustrates both a supply air temperature sensor 114 and a return air temperature sensor 118, other embodiments may include only one (or none) of the air temperature sensors.

Alternatively, or in addition, the HVAC system 100 may include a pressure sensor and/or air flow sensor, which can be located in the supply 116 of the HVAC system 100, the return 120 of the HVAC system 100, etc. The pressure sensor and/or air flow sensor are in communication with the controller 112, via wired and/or wireless communication. The controller 112 is configured to disable the gas valve 104 in response to a detected pressure or a detected air flow outside of a specified operating air supply range.

For example, when no air flow is detected in the HVAC system 100, or a reduced air flow is detected in the HVAC system 100, this can indicate that the circulator motor 108 is not operating properly. The pressure sensor and/or air flow sensor are optional, and may be used with or without air temperature sensors 114 and 118.

Any suitable specified operating ranges may be used to determine whether the circulator motor 108 is operating properly. For example, the specified operating current range could include current value(s) that would be expected during normal operation of the circulator motor 108.

As one example, the specified operating current range could include current value(s) corresponding to a 120 VAC supply, such as about 3 amps or greater, etc. In an ECM motor, a DC bus may be used to operate the motor using a current that is not sinusoidal. For example, a 10 amp peak current may be measured but the current may be near zero during a majority of operation, such that RMS is lower than a square root of two factor that would otherwise occur for sine waves. In this case, about 3 amps RMS may be measured with 10 amp peak currents, so a problem may be detected when a sampled peak current is less than about 3 amps.

Detected current values outside of the specified operating current range could indicate that the circulator motor 108 has failed or is not operating properly, because the circulator motor 108 is not receiving a supply current that would normally occur during proper operation.

The specified operating temperature range can include any suitable temperature range that indicates the circulator motor 108 is properly circulating air through the system. For example, an increase of less than twenty degrees Celsius in the supply 116 and/or the return 120 may indicate that the circulator motor 108 is properly circulating heated air through the HVAC system 100.

The rise in temperature of the heated supply air should not exceed a specified limit and/or rate of increase if the air is circulating properly. Therefore, the supply air temperature peak value and/or rate of increase (e.g., slope, etc.) may be measured to determine whether there is a problem with circulation air flow.

The specified air supply range can include any suitable air pressure and/or air flow that indicates the circulator motor 108 is properly circulating air through the system. For example, when a blower is turned on from an idle state, an increase in pressure of about 1/10 inch water column in the supply air duct in the HVAC system 100, an increase of at least five hundred cubic feet per minute (CFM) of air flow in the HVAC system 100, an air velocity of at least 1 meter per second of air flow in the HVAC system 100, etc., may indicate that the circulator motor 108 is properly circulating air through the HVAC system 100.

In some embodiments, it may be preferable to have about 0.015 CFM/BTU (e.g., about 900 CFM for 60,000 BTU, about 1500 CFM for 100,000 BTU, etc.). The desired values may depend on a size of the furnace. If the burner 106 knows the size of the furnace, the burner 106 may use the information to detect a failure. Additionally, or alternatively, a specified operating range value may be set at a threshold of about 500 CFM, etc. In some cases, a threshold setting could be varied based on a size of the HVAC system 100 (e.g., a small setting, a medium setting, a large setting, etc.), which may be set at a factory, during installation, etc.

In some embodiments, the controller 112 may be configured to detect a voltage of a control signal supplied to the circulator motor 108. This can allow the controller 112 to determine whether a run command is sent out correctly, to narrow down a failure to the circulator motor 108.

The circulator motor 108 may include any suitable motor, such as a permanent split capacitance (PSC) motor, an X-13 type electronically commutated motor (ECM), etc. In some cases, the controller 112 may detect whether the circulator motor 108 includes a shared optoisolator between taps of the motor, to identify a type of the circulator motor 108.

Figure 2:
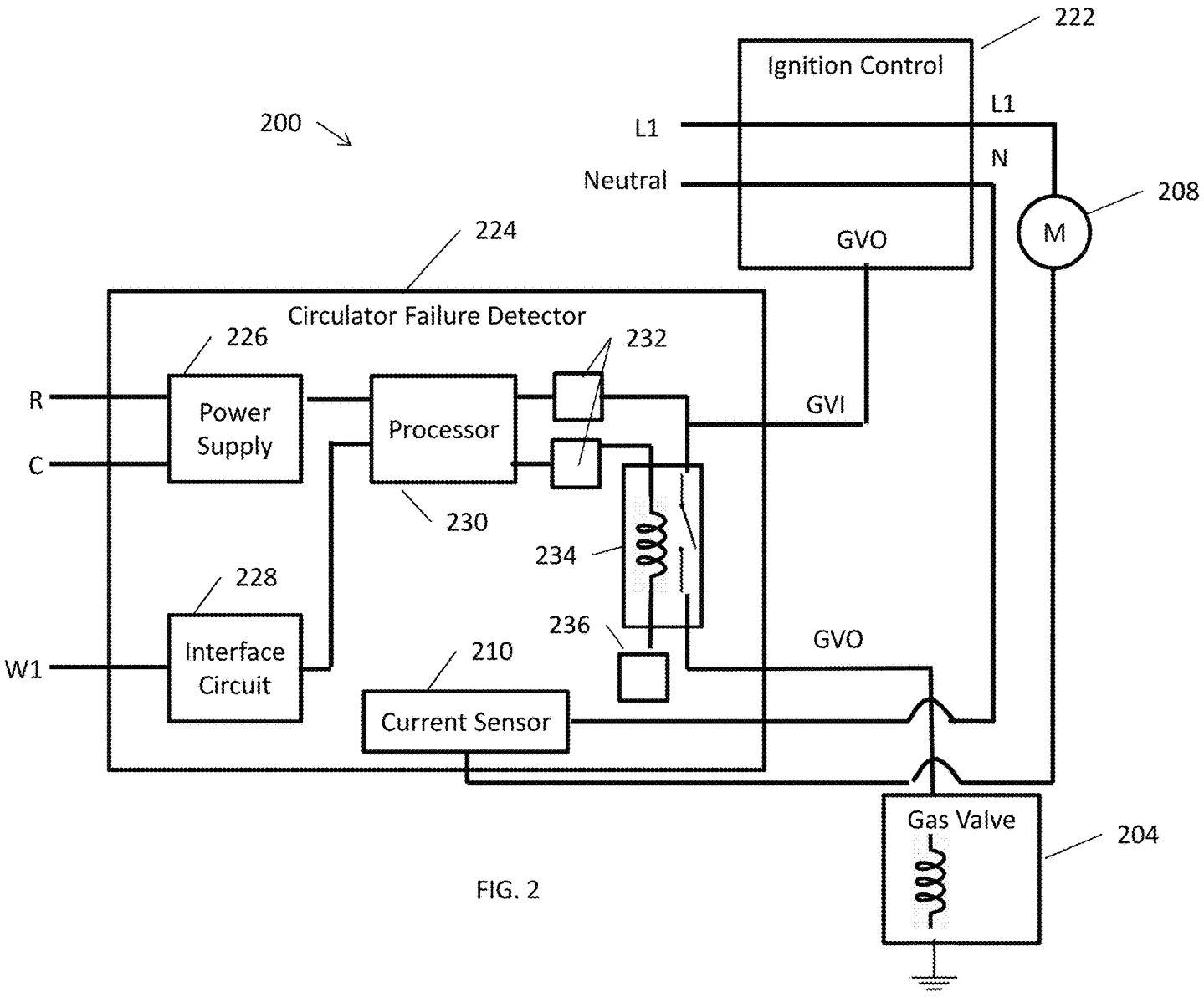
FIG. 2 is a wiring diagram of an HVAC system according to another example embodiment of the present disclosure.

FIG. 2 illustrates an exemplary embodiment of an HVAC system 200 for detecting a circulator motor failure. The HVAC system 200 includes a furnace having a gas valve 204. The gas valve 204 can operate a burner for heating air, etc., and may be turned on and off (e.g., enabled and disabled) as desired to control the burner 106.

The HVAC system 200 also includes an ignition control 222 that receives a line supply L1 and a neutral N. The ignition control 222 outputs a supply current L1 to a circulator motor 208, and a gas valve output (GVO) control signal for operating the gas valve 204.

A circulator failure detector 224 (e.g., a controller, etc.) receives a gas valve input (GCI) control signal from the ignition control 222. The circulator failure detector 224 includes a power supply 226 that receives power signals R and C, and a first interface circuit 228 that receives a control signal W1.

For example, in residential HVAC systems, a 24 VAC transformer may receive 120 VAC on a primary side and supply 24 VAC on a secondary side. The 24 VAC isolated transformer can supply the 24 VAC power to a burner control via two wires, which may be referred to as 'TH' and 'TR'. Wire TR is often tied to earth ground, with the wire TH at 24 VAC. At the burner control, the wire TH may be fused and passed to a thermostat as 'R'. The thermostat can then have relays to connect the input R to inputs of a burner control. In some cases, the thermostat will connect W1 to R for a call for heat, and will not connect W1 to R when there is no call for heat.

The circulator failure detector 224 also includes a microprocessor 230, secondary interface circuits 232, a current sensor 210 (e.g., a current transformer, etc.), a relay switch 234, and a relay power interface 236. The current sensor 210 senses a current supplied to the circulator motor 208. When the sensed current is outside of a specified operating current range, the relay switch 234 can disable the gas valve 204 (e.g., by interrupting the gas valve control signal from the ignition control 222 to the gas valve 204, etc.).

Figure 3:
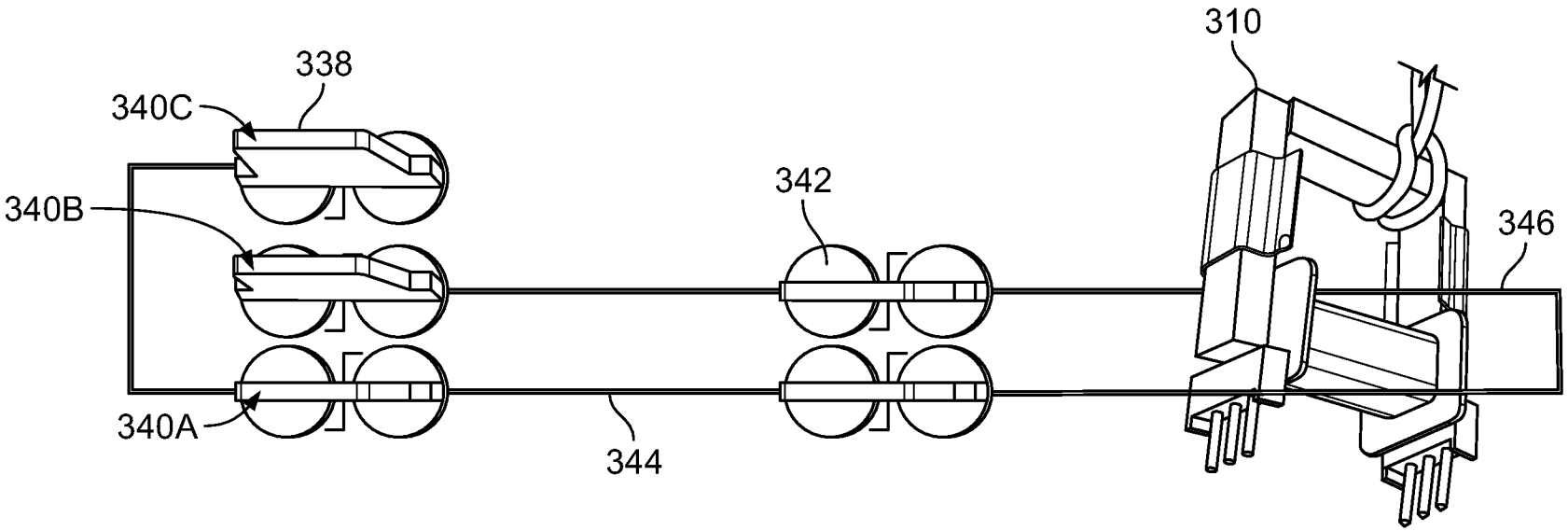
FIG. 3 is wiring diagram of a multi-position connector and a current transformer according to yet another example embodiment of the present disclosure.

FIG. 3 illustrates a wiring arrangement for a current transformer 310. As shown in FIG. 3, a first multi-position connector 338 on a control board (not shown) includes three connectors 340A, 340B and 340C. For example, connector 340A may receive L1 line power into the control board from a power supply, connector 340C may supply L1 line power to a 24 VAC transformer, etc.

The first multi-position connector 338 is electrically coupled to a second multi-position connector 342 via copper traces 344. From there, a wire and/or bus bar 346 extends through a current transformer 310, which allows the current transformer 310 to detect a current supplied to a circulator motor. In some embodiments, the current transformer 310 may be an upright current transformer.

In another example embodiment, an HVAC system includes a furnace including a gas valve, a circulator motor to circulate air through the HVAC system, and at least one of a return air temperature sensor, a supply air sensor, a pressure sensor, or an air flow sensor.

The HVAC system also includes a controller in communication with said at least one of a return air temperature sensor, a supply air sensor, a pressure sensor, or an air flow sensor. The controller is configured to disable the gas valve in response to a detected return air temperature or a detected supply air temperature outside of a specified operating temperature range, or in response to a detected pressure or a detected air flow outside of a specified operating air supply range. The circulator motor may include one of a permanent split capacitance motor and an X-13 electronically commutated motor.

According to another example embodiment of the present disclosure, a method of operating a gas valve in an HVAC system is disclosed. The HVAC system includes a circulator motor to circulate air through the HVAC system, and a current sensor.

The method includes detecting a current supplied to the circulator motor using the current sensor, and disabling the gas valve when a detected current supplied to the circulator motor is outside of a specified operating current range. A detected current to the circulator motor outside of the specified operating current range is indicative of a malfunction of the circulator motor.

In some embodiments, the current sensor comprises a current transformer or a Hall effect sensor. The HVAC system may include one or more wires or bus bars coupled to the circulator motor to supply the current to the circulator motor, with at least one of the one or more wires or bus bars extending through the current transformer. The wire or bus bar extending through the current transformer can be coupled with a multi-position connector on a circuit board.

Alternatively, or additionally, a bus bar can be soldered in place and extend through the current transformer so no additional connections are needed. In some cases, a single connector may be used with a lay-down version of a current transformer (e.g., with a quarter-inch male spade in the center of the current transformer, etc.).

The method may include disabling the gas valve in response to detecting a return air temperature or a detected supply air temperature outside of a specified operating temperature range, or in response to detecting a pressure or an air flow outside of a specified operating air supply range.

Example HVAC systems and controllers described herein may be configured to perform operations using any suitable combination of hardware and software. For example, the HVAC systems and controllers may include any suitable circuitry, logic gates, microprocessor(s), computer-executable instructions stored in memory, etc., operable to cause the HVAC systems and controllers to perform actions described herein (e.g., disabling a gas valve, etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An HVAC system comprising:

a heated air furnace including a gas valve;

an electronically controlled circulator motor to circulate heated air through the HVAC system, wherein the electronically controlled circulator motor comprises an electronically commutated motor (ECM);

a current sensor configured to detect a current supplied to the electronically controlled circulator motor, and measure a peak of the detected current supplied to the electronically controlled circulator motor; and a controller configured to:

determine whether the current supplied to the electronically controlled circulator motor is outside of a specified operating range by determining whether the measured peak of the detected current is below a specified current threshold value indicative that the electronically controlled circulator motor is not running or is running at an incorrect speed; and disable the gas valve by opening a relay switch electrically coupled with the gas valve to interrupt a gas valve control signal from the controller to the gas valve, in response to determining that the current supplied to the electronically controlled circulator motor is outside of the specified operating current range due to the measured peak of the detected current being below the specified current threshold value, wherein the detected current to the electronically controlled circulator motor outside of the specified operating current range is indicative of a malfunction of the electronically controlled circulator motor.

2. The HVAC system of claim 1, wherein the current sensor comprises a current transformer.

3. The HVAC system of claim 2, further comprising one or more wires or bus bars coupled to the electronically controlled circulator motor to supply the current to the electronically controlled circulator motor, wherein at least one of the one or more wires or bus bars extends through the current transformer.

4. The HVAC system of claim 3, wherein the at least one wire or bus bar extending through the current transformer is coupled with a multi-position connector on a circuit board.

5. The HVAC system of claim 1, wherein the current sensor comprises a Hall effect sensor.

6. The HVAC system of claim 5, further comprising a panel including an electrically-conductive trace electrically coupled with the electronically controlled circulator motor to supply the current to the electronically controlled circulator motor, wherein the Hall effect sensor is mounted on an opposite side of the panel from the electrically-conductive trace.

7. The HVAC system of claim 1, further comprising a return air temperature sensor or a supply air sensor in communication with the controller, wherein the controller is configured to disable the gas valve in response to a detected return air temperature or a detected supply air temperature outside of a specified operating temperature range.

8. The HVAC system of claim 1, further comprising a pressure sensor or an air flow sensor in communication with the controller, wherein the controller is configured to disable the gas valve in response to a detected pressure or a detected air flow outside of a specified operating air supply range.

9. The HVAC system of claim 1, wherein the specified operating current range includes a current value corresponding to a 120 VAC supply.

10. The HVAC system of claim 1, wherein the controller is configured to detect a voltage of a control signal supplied to the electronically controlled circulator motor.

11. The HVAC system of claim 1, wherein the electronically controlled circulator motor includes one or more taps, and the controller is configured to detect a current in the one or more taps of the electronically controlled circulator motor.

12. The HVAC system of claim 11, wherein the controller is configured to detect whether the electronically controlled circulator motor includes a shared optoisolator between the taps of the electronically controlled circulator motor, to identify a type of the electronically controlled circulator motor.

13. The HVAC system of claim 1, wherein the electronically commutated motor comprises an X-13 electronically commutated motor.

14. The HVAC system of claim 1, wherein the controller is configured to receive the detected current during at least one of a startup of the furnace and a subsequent cycle of the heated air furnace.

15. A method of operating a gas valve in an HVAC system, the HVAC system including an electronically controlled circulator motor to circulate heated air through the HVAC system, and a current sensor, the method comprising:

detecting, by the current sensor, a current supplied to the electronically controlled circulator motor, wherein the electronically controlled circulator motor comprises an electronically commutated motor (ECM);

measuring a peak of the detected current supplied to the electronically controlled circulator motor;

determining whether the detected current supplied to the electronically controlled circulator motor is outside of a specified operation range by determining whether the measured peak of the detected current is below a specified current threshold value indicative that the electronically controlled circulator motor is not running or is running at an incorrect speed; and disabling the gas valve by varying a modulation setting of the gas valve or opening a relay switch electrically coupled with the gas valve to interrupt a gas valve control signal from the controller to the gas valve, in response to determining that the current supplied to the electronically controlled circulator motor is outside of the specified operating current range due to the measured peak of the detected current being below the specified current threshold value, wherein the detected current to the electronically controlled circulator motor outside of the specified operating current range is indicative of a malfunction of the electronically controlled circulator motor.

16. The method of claim 15, wherein the current sensor comprises a current transformer or a Hall effect sensor.

17. The method of claim 16, further comprising one or more wires or bus bars coupled to the electronically controlled circulator motor to supply the current to the electronically controlled circulator motor, wherein the current sensor comprises the current transformer, at least one of the one or more wires or bus bars extends through the current transformer, and the at least one wire or bus bar extending through the current transformer is coupled with a multi-position connector on a circuit board.

18. The method of claim 15, further comprising disabling the gas valve in response to detecting a return air temperature or a detected supply air temperature outside of a specified operating temperature range, or in response to detecting a pressure or an air flow outside of a specified operating air supply range.

19. An HVAC system comprising:

a heated air furnace including a gas valve;

an electronically controlled circulator motor to circulate heated air through the HVAC system, wherein the electronically controlled circulator motor comprises an electronically commutated motor (ECM);

at least one of a return air temperature sensor, a supply air sensor, a pressure sensor, or an air flow sensor; and a controller in communication with said at least one of a return air temperature sensor, a supply air sensor, a pressure sensor, or an air flow sensor, the controller configured to disable the gas valve by opening a relay switch electrically coupled with the gas valve to interrupt a gas valve control signal from the controller to the gas valve, in response to determining that a measured peak of a current supplied to the electronically controlled circulator motor is below a specified threshold value indicative that the electronically controlled circulator motor is not running or is running at an incorrect speed, and at least one of a detected return air temperature or a detected supply air temperature is outside of a specified operating temperature range and a detected pressure or a detected air flow is outside of a specified operating air supply range.

20. The HVAC system of claim 1, wherein the current sensor is integrated with the controller or is located on a same circuit board as the controller.

* * * * *